United States Patent [19]

McGuiness et al.

[11] Patent Number: 4,647,368

[45] Date of Patent: Mar. 3, 1987

[54] NAPHTHA UPGRADING PROCESS

[75] Inventors: Mary P. McGuiness, Westmont; Kenneth M. Mitchell, Mount Laurel; Robert A. Ware, Deptford, all of N.J.

[73] Assignee: Mobil Oil Corporation, New York, N.Y.

[21] Appl. No.: 787,565

[22] Filed: Oct. 15, 1985

[51] Int. Cl.[4] ..... C10G 69/08

[52] U.S. Cl. ..... 208/60; 208/70; 208/89; 208/111

[58] Field of Search ..... 208/60, 70, 59, 89, 208/111

[56] References Cited

U.S. PATENT DOCUMENTS

| | | | |
|---|---|---|---|
| 2,905,619 | 9/1959 | Sutherland | 208/64 |
| 3,663,424 | 5/1972 | Jaffe | 208/59 |
| 3,758,628 | 9/1973 | Strickland et al. | 208/58 X |
| 3,770,614 | 11/1973 | Graven | 208/62 |
| 3,788,975 | 1/1974 | Donaldson | 208/60 |
| 3,843,510 | 10/1974 | Morrison et al. | 208/111 |
| 3,923,641 | 12/1975 | Morrison | 208/111 |
| 3,933,619 | 1/1976 | Kozlowski | 208/60 |
| 3,953,320 | 4/1976 | Peck et al. | 208/111 |
| 3,974,061 | 8/1976 | Quisenberry | 208/65 |
| 4,162,212 | 7/1979 | Miller | 208/79 |
| 4,181,599 | 1/1980 | Miller et al. | 208/79 |
| 4,191,634 | 3/1980 | Miller | 208/65 |
| 4,241,231 | 12/1980 | Gibson et al. | 585/748 |
| 4,304,657 | 12/1981 | Miller | 208/135 |
| 4,419,220 | 12/1983 | La Pierre et al. | 208/111 |
| 4,428,819 | 1/1984 | Shu et al. | 208/46 |

*Primary Examiner*—Brian E. Hearn
*Assistant Examiner*—O. Chaudhuri
*Attorney, Agent, or Firm*—Alexander J. McKillop; Michael G. Gilman; Malcolm D. Keen

[57] ABSTRACT

An upgrading process for paraffinic naphthas subjects a full range naphtha to hydrocracking over a zeolite beta hydrocracking catalyst to effect a selective, partial hydrocracking in which the higher molecular weight n-paraffinic components of the naphtha are hydrocracked preferentially to the lower molecular weight components with concurrent isomerization of n-paraffins to isoparaffins, to form a hydrocracked effluent which comprises isobutane, $C_5$ to $C_7$ paraffins and relatively higher boiling naphthenes and paraffins. The hydrocracked effluent is split to remove the isobutane and the $C_5$ and $C_7$ paraffins with the balance of the higher boiling components being used as a reformer feed. Removal of the $C_5$ and $C_7$ paraffins permits improved reformer operation with the production of a higher octane product. The isomerization of the paraffins which occurs in the hydrocracking step provides a $C_5$ to $C_7$ paraffinic fraction which is of relatively higher octane number because of the shift to isoparaffins, permitting this component to be used as a gasoline blending component.

16 Claims, No Drawings

NAPHTHA UPGRADING PROCESS

FIELD OF THE INVENTION

The present invention relates to a process for upgrading petroleum naphtha to form gasoline boiling range products having improved octane performance.

BACKGROUND OF THE INVENTION

Petroleum naphtha stocks, that is, petroleum naphthas of $C_5$-400° F. (about $C_5$-200° C.) boiling range may be converted to high octane gasoline by catalytic reforming. The low boiling ($C_5$ to $C_7$) paraffinic hydrocarbons, referred to as light straight run (LSR) naphthas which comprise a significant proportion of the full range of naphtha are, however, difficult to reform and for this reason, are usually removed from the full range naphtha by fractionation in order to improve reformer performance. Although the LSR naphtha generally has a boiling point in the gasoline range, for example, from 35° to 90° C. (94° to 193° F.) they are generally deficient in terms of octane quality because of their relatively high content of straight chain, n-paraffins. In spite of this defect, however, it has become common practice to include these napthas in the gasoline pool and to make up the octane deficiency by the addition of high octane reformate and lead-containing octane improvers. Because the use of lead octane improvers must now be reduced and possibly eliminated in the near future, there is currently a need for supplementing the octane rating of the gasoline pool by other methods. Although the amount of reformate in the pool could be increased, reforming is relatively expensive and because reforming capacity in a refinery may be limited, it is often desirable to seek other alternatives for improving octane. Furthermore, the inability to use lead-containing octane improvers in the gasoline pool coupled with the limitations on reforming capacity will mean that large amounts of light straight run (LSR) naphtha will have to be diverted from the gasoline pool to other possible uses, e.g. as olefin feed stock, although this has the disadvantage that the final products may be of relatively low value compared to the gasoline which previously used the LSR as such (Oil and Gas Journal, June 3, 1985, p. 47). Even if reforming capacity were available to deal with the LSR, the further problem which will be encountered is that LSR naphtha has extremely poor reforming characteristics because of its paraffinic nature so that even if reforming capacity were available, it will be largely misused if LSR were to be used as the feedstock. Accordingly, it would be desirable to devise some method for upgrading the full range naphthas which are available in refineries to form gasoline products of improved octane characteristics and, in addition, to ensure that the LSR portion of these naphthas has a sufficiently high octane rating to permit it to be blended directly into the gasoline pool without the need for lead-containing octane improvers.

Various proposals have been made in the past for improving the octane performance of various naphthas and these have generally used zeolite catalysts such as HY or HZSM-5 as described, for example, in U.S. Pat. Nos. 4,191,634 and 4,304,657. Alternatively, they have used catalysts similar to reforming catalysts containing chlorided noble metals such as chlorided-platinum-alumina-rhenium, as described in U.S. Pat. No. 4,241,231. Many of these catalysts systems have been undesirable from various points of view. For example, the chlorided reforming type catalysts require regeneration and rejuvenation and because the process is endothermic in nature, it requires the use of high temperatures, e.g. 350° to 420° C. with a constant high heat input. Systems using relatively small pore size zeolites, for example, the intermediate pore size zeolites such as ZSM-5 have other disadvantages, including excessive conversion of the naphtha to $C_3$ and lighter products. Thus, there is a continuing need for refinery processes which are capable of converting naphthas to high octane gasoline in good yields.

SUMMARY OF THE INVENTION

We have now found that full range naphthas may be upgraded over a catalyst based on zeolite beta to produce a reformer feed of high quality together with an LSR fraction of improved octane rating. During the processing, the naphtha is preferably subjected to an initial hydrotreating in order to remove heteroatom-containing impurities, after which it is subjected to mild hydrocracking over the zeolite beta catalyst. The effluent from the hydrocracking step is then split to remove a low boiling butane fraction, principally iso-butane, together with an intermediate LSR fraction comprising $C_5$ to $C_7$ paraffins. The removal of this $C_5$ to $C_7$ paraffinic fraction eliminates the detrimental effect of these paraffins in the reformer feed so that the residue, which principally comprises $C_{6+}$ naphthenes, $C_{8+}$ paraffins and aromatics can be fed directly to the reformer to produce a relatively high octane product which is suitable for blending into the gasoline pool. The light straight run (LSR) $C_5$ to $C_7$ fraction which is separated from the reformer feed and the butane fraction has a relatively high octane rating and may be blended directly into the motor gasoline pool. The isobutanes provide a high quality feed for the alkylation unit, itself a further source of high octane gasoline. Thus, the present process effectively upgrades the full range naphtha, producing higher quality reformate and higher quality, low boiling light paraffins which are either of relatively good octane quality or which can be converted by conventional processing steps to high octane quality products.

DETAILED DESCRIPTION

Feedstock

The petroleum refinery process streams which are useful for feeds for the present process comprise full range naphthas, i.e. having a nominal boiling range from $C_5$ to about 200° C. (about 390° F.). These naphthas generally have octane numbers (R+0) below about 65 and are generally undesirable as components for a motor gasoline pool or as gasoline blending stock. They normally contain major amounts of $C_5$ and $C_6$ components together with lesser amounts of $C_4$, $C_7$ and higher hydrocarbons. The paraffin content is normally at least 40% by weight with naphthenes making up most of the remainder, normally at least 25% by weight of the total. Aromatics may be present in relatively small amounts, normally less than 20% and usually not more than about 15% of the total.

Process Conditions

In the first step of the process, the naphtha is subjected to hydrotreating to remove heteroatom-containing impurities and to remove any residual olefins. For this purpose, a conventional hydrotreating catalyst may be used comprising a hydrogenation-dehydrogenation component on a porous inorganic oxide support such as alumina, silica or silica-alumina. The hydrogenation-dehydrogenation component is suitably a base metal of groups VIA or VIIIA of the Periodic Table (The Periodic Table used in this specification is the IUPAC Table) and usually, the metal will be a base metal or combination of base metals, although noble metals such as platinum or palladium may also be used. Suitable base metals include, for example, molybdenum, nickel, cobalt and tungsten and combinations of base metals such as nickel-tungsten, cobalt-molybdenum, nickel-tungsten-molybdenum are especially suitable. The content of the metal will generally be in the range of 2–20%, depending upon the hydrogenation activity of the metal with relatively more of the base metal components being required, as compared to the more active noble metals. Hydrotreating conditions will be conventional, employing elevated temperature and pressure and the presence of free hydrogen. Temperatures from about 250° to 450° C. (about 480° to 840° F.) and pressures up to about 30,000 kPa (about 4350 psig) and generally from 3000 to 15000 kPa (about 420 to 2160 psig) with hydrogen circulation rates up to 1000 n.l.l.$^{-1}$ (about 5620 SCF/bbl) will generally be suitable.

In the second step of the process, the hydrotreated naphtha is subjected to partial hydrocracking over a catalyst which comprises zeolite beta and a hydrogenation-dehydrogenation component. Zeolite beta has the property which is presently believed to be unique, of effecting isomerization of paraffins, especially straight chain paraffins, while being capable, at the same, of effecting a bulk conversion of the feed to lower boiling components. In the present hydrocracking step, therefore, the hydrotreated naphtha undergoes a number of different reactions. Normal paraffins such as n-$C_6$, n-$C_7$, n-$C_8$, n-$C_9$ and n-$C_{10}$ paraffins are isomerized to iso-paraffins and iso-paraffins undergo partial cracking, primarily to isobutane and isopentane. However, the degree of cracking at this stage is limited so as to avoid the production of large quantities of the $C_{5-}$ products. Generally, the bulk conversion to $C_{5-}$ products should be limited to not more than 25 volume percent and preferably not more than 20 volume percent. In most cases, up to 10 volume percent conversion to $C_{5-}$ products will be adequate to produce an improved reformer feed. By limiting the bulk conversion in this way, the production of methane and ethane is minimized. Because the reactivity for cracking of the various components in the hydrotreated naphtha feed is in inverse relationship to molecular weight, i.e. $C_{10}$ cracks more readily than $C_9$ which, in turn, cracks more readily than $C_8$, the controlled hydrocracking in this step tends to remove the higher molecular weight paraffins selectively, with the result that the product is relatively rich in uncracked $C_7$ paraffins together with naphthenes and aromatics which have not been affected by the hydrocracking. The uncracked paraffins have, however, been subjected to isomerization so that the hydrocracker effluent contains $C_6$ and $C_7$ iso-paraffins together with significant quantities of $C_4$ and $C_5$ isoparaffins produced by cracking. The $C_6$ and $C_7$ paraffins may be present either as n-paraffins or isoparaffins: the n-$C_6$ and n-$C_7$ paraffins are derived directly from the feed where they have passed through the hydrocracker without undergoing a bulk conversion; the iso-$C_6$ and iso-$C_7$ paraffins are formed by isomerization of the n-paraffins in the feed but in either case, relatively little hydrocracking of these components takes place under the conditions selected.

The hydrocracking catalyst used in this step comprises a hydrogenation-dehydrogenation component on zeolite beta as an acidic support. A matrix material such as alumina, silica-alumina or silica may also be present in which case the zeolite will usually comprise 10 to 95, preferably 40 to 70, weight percent of the catalyst. The hydrogenation-dehydrogentation component of groups Va, VIA, VIIA or VIIIA of the Periodic Table may be of the type described above for the hydrocracking catalyst and again, is preferably of the base metal type, e.g. nickel, cobalt or a combination of base metals such as cobalt-molybdenum, nickel-tungsten, etc., although catalysts containing noble metals such as platinum or palladium may also be used. Zeolite beta is a known zeolite and suitable hydrocracking catalysts based on zeolite beta are described in U.S. Pat. No. 4,518,485, to which reference is made for a description of these hydrocracking catalysts. As mentioned in U.S. Pat. No. 4,518,485, the use of the more highly siliceous forms of zeolite beta having structural silica:alumina ratios above 30:1 are preferred.

It is generally preferred to decouple the hydrotreating and hydrocracking reactors by an interstage separation removing nitrogen and sulfur in order to obtain extended catalyst life. Although the base metal hydrocracking catalysts such as Ni-W/beta have superior resistance to poisoning if no interstage separation is carried out, it has been found that they will suffer excessive aging in cascade mode operation (no interstage separation) with sulfur-containing feeds.

The hydrocracking may be carried out under fairly conventional naphtha hydrocracking conditions, that is, at elevated temperature and pressure and in the presence of hydrogen gas. Temperatures will usually be in the range of 200° to 450° C. (about 400° to 840° F.), more commonly in the range 225° to 375° (about 440° to 710° F.), with total system pressures generally ranging from about 500 to 10,000 kPa (about 60 to 1435 psig), more commonly from 1500 to 5000 kPa (about 200 to 710 psig), with hydrogen pressure generally representing about 25 to 60 percent of the total pressure. Space velocity (LHSV) will generally be from 1 to 10 hu$^{-1}$, more usually from 1 to 5 hr$^{-1}$. Hydrogen circulation rates are typically in the range of 30 to 250 n.l.l.$^{-1}$ (about 170 to 1400 SCF/Bbl), more commonly 70 to 120 n.l.l.$^{-1}$ (about 395 to 675 SCF/Bbl). The product selectivity for iso-$C_4$ and iso-$C_5$ products is favored by the use of relatively lower temperatures, with high iso/normal $C_4$ and $C_5$ ratios typically four times equilibrium being obtained at temperatures below about 290° C. (about 550° F.). Variations in pressure and space velocity have relatively little effect on selectivity although catalyst aging is increased by lower hydrogen pressures. If base metal hydrocracking catalysts, e.g. Ni-W/beta, are used higher hydrogen pressures are preferred because the base metals are relatively lower in hydrogenation activity than the noble metals such as platinum, although the noble metals are less resistant to sulfur poisoning if there is no separation of heteroatom-containing impurities. Selectivity to isobutane and isopentane during the hydrocracking is, however, independent of catalyst hydrogenation function and therefore imposes no preference for the choice of the hydrogenation component.

Following the hydrocracking step, the hydrocracker effluent is separated in a fractionator to provide three product cuts. The lowest boiling fraction comprises a $C_4$ fraction which is principally isobutane. This fraction provides a highly useful feed for an alkylation unit to produce high octane gasoline. The second fraction is an upgraded light straight run (LSR) fraction having a boiling range of approximately $C_5$ to 200° F. ($C_5$ to 93° C.). This fraction contains almost all the $C_5$ to $C_7$ paraffins which have been generated or passed without cracking through the hydrocracker. However, because a significant amount of isomerization has occurred in the hydrocracking step, there is a relatively high ratio of iso to n-paraffins in this fraction, providing an improved octane rating which enables this isomerized LSR to be blended directly into the motor gasoline pool without the need for large amounts of octane improvers.

The final product fraction from the hydrocracking is a 200° F.+ (93° C.+) fraction which comprises mostly $C_{6+}$ naphthenes, $C_{8+}$ paraffins together with residual aromatics such as toluene (BP 230° F., 110° C.). Because this fraction contains few of the $C_5$ to $C_7$ paraffins which are difficult to reform as well as an increased concentration of naphthenes resulting from the conversion of the backend paraffins to lighter products, an improvement in reformer operation is obtained, with increases in reformate octane at equivalent cycle length or improved cycle length at equivalent severity. Thus, the reformer may be operated at a lower space velocity with a reduced compositional shift because of the reduced back end ($C_9$, $C_{10}$ paraffin content). The use of zeolite beta therefore provides a number of distinct advantages.

Reforming may be carried out in the conventional manner, using conventional catalysts and conditions. Thus, the catalysts will generally comprise a noble metal on a porous, inorganic oxide support such as alumina, silica-alumina or silica with noble metal catalysts such as platinum, platinum-rhenium, platinum-irridium, platinum-irridium-rhenium being preferred. Activation and rejuvenation procedures involving the use of halogens and halides may also be employed, as is conventional. Since reforming is an endothermic operation, temperatures will be relatively high, usually at least 450° C. (about 840° F.) and usually in the range 450° to 510° C. (about 840° to 950° F.). The off-gas from the reformer, comprising $C_{4-}$ paraffins may be passed to the alkylation unit for further production of gasoline.

In summary, therefore, the present processing scheme has a number of advantages. First, the capability of zeolite beta of producing large quantities of isobutane by naphtha hydrocracking enables significant increases in the isobutane yield for alkylation to be obtained. Second, the isomerization activity of the zeolite beta results in an increase in the octane rating of the LSR fraction due to the $C_5$–$C_7$ iso-paraffins which are generated by isomerization and cracking of the backend paraffins or isomerization of the $C_5$–$C_7$ n-paraffins in the feed. Third, the separation of the front end ($C_6$, $C_7$) paraffins from the reformer feed in the distillation step coupled with the conversion of the backend $C_9$–$C_{11}$ paraffins during the hydrocracking step provides the reformer with a feed of higher naphthene content with is amenable to upgrading by the characteristics reforming reactions, to form an aromatic, high octane gasoline product.

EXAMPLES 1 TO 3

A naphtha upgrading process was carried out using a raw naphtha having the properties listed in Table 1 below.

TABLE 1

| Naphtha Feed Properties | |
|---|---|
| Sp. gravity | 0.72 |
| Nitrogen, ppmw | 15 |
| Sulfur, wt % | 0.215 |
| Distillation (D86) °C. (°F.) | |
| 5% | 52 (126) |
| 10 | 63 (145) |
| 30 | 93 (199) |
| 50 | 118 (244) |
| 70 | 144 (291) |
| 90 | 179 (354) |
| End pt. | 200 (392) |
| Paraff/naphth/aroms: | |
| Paraffins, wt % | 57.5 |
| Naphthenes | 30.5 |
| Aromatics | 12.0 |

The naphtha feed was hydrotreated over a conventional Co-Mo/$Al_2O_3$ hydrocracking catalyst (Ketjen-Fine 124) at 315° C. (600° F.), 4238 kPa (600 psig) hydrogen pressure at a hydrogen circulation rate of 107 n.l.l.$^{-1}$ (600 SCF/Bbl). In Example 1 (comparison case), the hydrotreated naphtha was reformed directly. In Examples 2 and 3, the hydrotreated naphtha was first subjected to hydrocracking over a hydrocracking catalyst comprising 0.6% platinum on an extrudate of unsteamed zeolite beta (30:1 silica:alumina) with an alumina matrix (50:50 by weight zeolite:alumina). Temperature was adjusted to give a 10 volume percent $C_{5-}$ conversion. The hydrotreaed, hydrocracked effluent (H-treat/HDC Effl.) in Examples 2 and 3 was then separated into three fractions comprising, respectively, a $C_{4-}$ fraction, a $C_5$ to 200° F. LSR and a 200° F.+ reformer feed. The reforming yields were obtained by simulating commercial operation with a commercially available Pt-Rh bimetallic reforming catalyst.

The conditions used are given in Table 2 below and the results in Table 3.

TABLE 2

| Reactor Operating Conditions | | | | | |
|---|---|---|---|---|---|
| | | Ex. 2 | | Ex. 3 | |
| | Ex. 1 Reformer | H-Crack | Reform. | H-Crack | Reform. |
| Temperature, | | | | | |
| °C. | 483 | 274 | 485 | 274 | 480 |
| (°F.) | (902) | (525) | (906) | (525) | (896) |
| Pressure, | | | | | |
| kPa | 2652 | 4238 | 2652 | 4238 | 2652 |
| (psig) | (370) | (600) | (370) | (600) | (370) |
| $H_2$ pressure, | | | | | |
| kPa | — | 2068 | — | 2068 | — |
| (psia) | — | (300) | — | (300) | — |
| LHSV, hr$^{-1}$ | 1.63 | 2.0 | 1.40 | 2.0 | 1.40 |
| Relative 1. day$^{-1}$ | 11300 | 15900 | 9700 | 15900 | 9700 |
| (BPSD) | (71) | (100) | (61) | (100) | (61) |
| RON | 96 | — | 98 | — | 96 |

TABLE 3

| | | Naphtha Upgrading | | | | | | | | |
|---|---|---|---|---|---|---|---|---|---|---|
| | | Example 1 H-treated Effl. | | | Example 2 H-treat/HDC Effl. | | | Example 3 H-treat/HDC Effl. | | |
| | Pretreater Feed | $C_4$— | $C_5$-200° LSR | Ref. Eff. | $C_4$— | $C_5$-200° LSR | Ref. Eff. | $C_4$— | $C_5$-200° LSR | Ref. Eff. |
| Wt % Pretreater Feed | 100 | 4.9 | 20.2 | 74.9 | 12.5 | 23.6 | 64.4 | 12.5 | 23.6 | 64.4 |
| Stream Composition, Wt % | | | | | | | | | | |
| $H_2$ (SCF/B) | — | — | — | 860 | — | — | 857 | — | — | 807 |
| $C_1$ | — | — | — | 1.9 | — | — | 2.2 | — | — | 2.1 |
| $C_2$ | 0.05 | 1.0 | — | 2.4 | 0.40 | — | 2.6 | 0.40 | — | 2.4 |
| $C_3$ | 0.76 | 15.6 | — | 4.7 | 17.8 | — | 4.9 | 17.8 | — | 4.5 |
| i-$C_4$ | 0.82 | 16.8 | — | 1.8 | 49.2 | — | 1.9 | 49.2 | — | 1.7 |
| n-$C_4$ | 3.25 | 66.6 | — | 3.6 | 32.7 | — | 3.7 | 32.7 | — | 3.4 |
| i-$C_5$ | 3.92 | — | 19.4 | 4.0 | — | 25.8 | 4.1 | — | 25.8 | 3.8 |
| n-$C_5$ | 5.30 | — | 25.5 | 2.0 | — | 22.7 | 2.0 | — | 22.7 | 1.9 |
| $C_6$+ | 85.9 | — | 55.1 | 77.9 | — | 51.5 | 76.9 | — | 51.5 | 78.6 |
| $C_5$+ | 95.1 | — | 100 | 83.9 | — | 100 | 83.0 | — | 100 | 84.3 |
| BPSD (Vol % Prtr feed) | | | | | | | | | | |
| Total Stream | 100 | — | 21.7 | — | — | 25.3 | — | — | 25.3 | — |
| $C_5$+ | 93.8 | — | 21.7 | 56.7 | — | 25.3 | 47.9 | — | 25.3 | 49.1 |
| i-$C_4$ | 1.1 | 1.1 | — | 1.7 | 7.9 | — | 1.6 | 7.9 | — | 1.4 |
| n-$C_4$ | 4.0 | 4.0 | — | 3.4 | 5.1 | — | 3.0 | 5.1 | — | 2.7 |
| $C_3$ | 1.1 | 1.1 | — | 4.9 | 3.1 | — | 4.4 | 3.1 | — | 4.0 |
| Combined iso-$C_4$ | 1.1 | | | 2.8 | | | 9.5 | | | 9.3 |
| $C_5$+ Properties | | | | | | | | | | |
| SPGR | 0.73 | — | 0.67 | 0.80 | | 0.67 | 0.80 | | 0.67 | 0.80 |
| RON + 0 | 63.4 | — | 74.0 | 96.0 | | 77.2 | 98.0 | | 77.2 | 96.0 |
| MON + 0 | 63.4 | — | 74.0 | 86.0 | | 75.9 | 87.6 | | 75.9 | 86.0 |
| RVP | 4.1 | — | 11.0 | 4.0 | | 11.7 | 4.2 | | 11.7 | 3.9 |

In Example 1, the comparison example, the naphtha is subjected only to hydrotreating and reforming. In Example 2, the feed was fully processed as described above and the results show that the reduced 200° F.+ (93+° C.) throughput provides flexibility in reformer operation. Example 2 demonstrates the improved reformate octane obtained under comparable reformer conditions to those used in Example 1. Alternatively, and as shown in Example 3, operation at equivalent severity to give comparable octane (RON) requires a lower temperature in the reformer which results in a lower aging rate and longer cycle durations because reformer cycles are typically constrained by reactor temperature limits.

Upgrading the full range naphtha over the zeolite beta hydrocracking catalyst provides a three-fold volume increase in isobutane as shown by the comparisons between Example 1 and Examples 2 and 3. Furthermore, the octane of the LSR is raised 3.2 RON over the base case (Example 1). Improved reformer performance provides a 2 RON boost.

We claim:

1. A method for upgrading a paraffinic naphtha including major amounts of $C_5$ and $C_6$ components to produce gasoline boiling range products of improved octane number, which comprises (i) hydrocracking the naphtha over a hydrocracking catalyst comprising zeolite beta and a hydrogenation-dehydrogenation component under conditions of elevated temperature and pressure and in the presence of hydrogen and at a conversion of not more than 25 volume percent to $C_5$- products, to effect a partial, preferential hydrocracking of the paraffins of relatively longer chain length in the naphtha and a concurrent isomerization of n-paraffins, to form a hydrocracking effluent comprising isobutane and higher boiling materials;

(ii) fractionating the hydrocracked effluent to form (i) an isobutane stream, (ii) a relatively low boiling stream having a boiling range of approximately $C_5$ to 200° F. and comprising $C_5$ to $C_7$ iso-paraffins, and (iii) a relatively higher boiling stream having an initial boiling point of approximately 200° F., and (iii) reforming the relatively high boiling point stream to form a gasoline boiling range product of improved octane rating.

2. A method according to claim 1 in which $C_8$ paraffins in the naphtha undergo hydrocracking to form isobutane.

3. A process according to claim 1 in which $C_9$ paraffins in the naphtha are hydrocracked to form isobutane and isopentane.

4. A process according to claim 1 in which $C_{10}$ paraffins in the naphtha are hydrocracked to form isobutane and isopentane.

5. A process according to claim 2 in which $C_8$ paraffins in the naphtha are hydrocracked to form isobutane and isomerized to form $C_8$ isoparaffins.

6. A process according to claim 1 in which the 200° F.+ reformer feed comprises $C_{6+}$ naphthenes, $C_{8+}$ paraffins and aromatics.

7. A process according to claim 1 in which the relatively low boiling fraction comprises principally $C_6$ and $C_7$ paraffins.

8. A process according to claim 1 in which the hydrocracking catalyst comprises a metal of groups VA, VIA, VIIA or VIIIA of the Periodic Table and zeolite beta.

9. A process according to claim 1 in which the hydrocracking catalyst comprises platinum or palladium and zeolite beta.

10. A process according to claim 8 in which the hydrocracking catalyst comprises a base metal or combination of base metals and zeolite beta.

11. A process according to claim 10 in which the hydrocracking catalyst comprises zeolite beta and at least one base metal selected from nickel, cobalt, tungsten or molybdenum.

12. A process according to claim 1 in which the zeolite beta has a silica:alumina ratio of at least 30:1.

13. A process according to claim 1 in which the hydrocracking catalyst comprises 10 to 95 percent by weight zeolite beta in an alumina binder.

14. A process according to claim 1 in which the hydrocracking catalyst comprises 40 to 70 percent by weight zeolite beta in an alumina binder.

15. A process according to claim 1 in which the naphtha is hydrotreaed prior to the hydrocracking step.

16. A method according to claim 1 in which the conversion in the hydrocracking step is not more than 10 volume percent to $C_{5-}$ products.

* * * * *